US005224454A

United States Patent [19]

Miyashita et al.

[11] Patent Number: 5,224,454

[45] Date of Patent: Jul. 6, 1993

[54] AIR-FUEL RATIO FEEDBACK CONTROL METHOD FOR INTERNAL COMBUSTION ENGINES

[75] Inventors: Yukio Miyashita; Kunio Noguchi; Hironao Fukuchi, all of Wako, Japan

[73] Assignee: Honda Giken Kogyo Kabushiki Kaisha, Tokyo, Japan

[21] Appl. No.: 751,478

[22] Filed: Aug. 29, 1991

[30] Foreign Application Priority Data

Sep. 17, 1990 [JP] Japan ..... 2-246722

[51] Int. Cl.[5] ..... F02D 41/14; F02D 41/12

[52] U.S. Cl. ..... 123/682; 123/493

[58] Field of Search ..... 123/325, 326, 489, 493; 364/431.05

[56] References Cited

U.S. PATENT DOCUMENTS

| | | | |
|---|---|---|---|
| 4,365,603 | 12/1982 | Shikata et al. | 123/489 |
| 4,445,482 | 5/1984 | Hasegawa et al. | 123/489 |
| 4,479,464 | 10/1984 | Kondo et al. | 123/489 |
| 4,572,129 | 2/1986 | Otobe | 123/493 X |
| 4,648,370 | 3/1987 | Kobayashi et al. | 123/489 |
| 4,723,521 | 2/1988 | Mieno et al. | 123/489 |
| 4,760,822 | 8/1988 | Mieno et al. | 123/325 |
| 4,958,612 | 9/1990 | Kato et al. | 123/489 |

FOREIGN PATENT DOCUMENTS 2-11842 1/1990 Japan .

*Primary Examiner*—Willis R. Wolfe

*Attorney, Agent, or Firm*—Armstrong, Westerman, Hattori, McLeland & Naughton

[57] ABSTRACT

An air-fuel ratio feedback control method for an internal combustion engine having an exhaust gas ingredient concentration sensor arranged in the exhaust passage and having output characteristics in approximate proportion to the concentration of an ingredient in exhaust gases from the engine, wherein when the engine is in a predetermined operating condition, the air-fuel ratio of an air-fuel mixture supplied to the engine is feedback-controlled to a desired air-fuel ratio dependent on the predetermined operating condition of the engine, and when the engine is in a predetermined deceleration condition, the fuel supply to the engine is cut off. When the engine has shifted from an operating condition other than the predetermined deceleration condition to the predetermined deceleration condition, the desired air-fuel ratio is held at a value assumed immediately before the engine shifts from the operating condition other than the predetermined deceleration condition to the predetermined deceleration condition, for a predetermined time period after the shifting. The feedback control of the air-fuel ratio is started with the held value as an initial value of the desired air-fuel ratio when the engine has shifted to the predetermined operating condition. Preferably, the desired air-fuel ratio is held at a value substantially corresponding to a central value of air-fuel ratio after the predetermined time period has elapsed.

4 Claims, 3 Drawing Sheets

| FIG. 2a | FIG. 2b |
|---|---|

AIR-FUEL RATIO FEEDBACK CONTROL METHOD FOR INTERNAL COMBUSTION ENGINES

BACKGROUND OF THE INVENTION

The present invention relates to a method of feedback-controlling the air-fuel ratio of an internal combustion engine, and more particularly, it relates to a method of this kind wherein the air-fuel mixture supplied to the engine is feedback-controlled to a desired air-fuel ratio in response to the output of an exhaust gas ingredient concentration sensor having output characteristics in approximate proportion to the exhaust gas ingredient concentration, and the fuel supply to the engine is cut off when the engine is in a predetermined deceleration region.

In methods for feedback-controlling the air-fuel ratio of an air-fuel mixture supplied to an internal combustion engine (referred to hereinafter as "supply air-fuel ratio") to a desired air-fuel ratio in response to the output of an exhaust gas ingredient concentration sensor having output characteristics proportional to the exhaust gas ingredient concentration, the desired air-fuel ratio is set according to operating conditions of the engine.

However, when the fuel supply is cut off (referred to hereinafter as "fuel cut") when the engine is in a predetermined deceleration region and the fuel supply is re-started upon termination of fuel cut, there is a problem that if the desired air-fuel ratio is immediately set to a value depending on an operating condition in which the engine is operating, upon re-starting of the fuel supply, feedback control cannot be properly performed based on the difference between the desired air-fuel ratio and the air-fuel ratio detected by the sensor, due to a response delay in the control system and other factors.

In order to resolve this problem, a method has been disclosed (Japanese Provisional Patent Publication No. 2-11842 (Kokai)) wherein the desired air-fuel ratio is immediately set upon termination of fuel cut to a leaner value than the proper value which should be set on the basis of the engine operating condition, and is then progressively increased to a richer value.

If the fuel cut period is relatively short, however, there is effectively no change in the engine operating condition. If the fuel cut period is relatively long, on the other hand, the engine operating condition does change such that in some cases it is better to adjust the air-fuel ratio to a richer value immediately when the fuel supply is restarted. According to the aforesaid method wherein the desired air-fuel ratio is progressively increased from a lean value to a rich value irrespective of the engine operating condition during the fuel cut period, it was sometimes impossible to adjust the system rapidly enough to obtain the desired air-fuel ratio.

SUMMARY OF THE INVENTION

It is therefore the object of the invention to provide an air-fuel ratio feedback control method wherein the supply air-fuel ratio is rapidly controlled to a desired value immediately after termination of fuel cut by suitably setting the desired air-fuel ratio.

To attain the above object, the present invention provides an air-fuel ratio feedback control method for an internal combustion engine having an exhaust passage, and an exhaust gas ingredient concentration sensor arranged in the exhaust passage, the sensor having output characteristics in approximate proportion to the concentration of an ingredient in exhaust gases from the engine, wherein when the engine is in a predetermined operating condition, the air-fuel ratio of an air-fuel mixture supplied to the engine is feedback-controlled to a desired air-fuel ratio dependent on the predetermined operating condition of the engine, and when the engine is in a predetermined deceleration condition, the fuel supply to the engine is cut off. The method comprises the following steps:

(1) when the engine has shifted from an operating condition other than the predetermined deceleration condition to the predetermined deceleration condition, holding the desired air-fuel ratio at a value assumed immediately before the engine shifts from the operating condition other than the predetermined deceleration condition to the predetermined deceleration condition, for a predetermined time period after the shifting; and (2) starting the feedback control of the air-fuel ratio with the held value as an initial value of the desired air-fuel ratio when the engine has shifted to the predetermined operating condition.

Preferably, the desired air-fuel ratio is held at a value substantially corresponding to a central value of the air-fuel ratio after the above predetermined time period has elapsed.

More preferably, the desired air-fuel ratio is held at a value substantially corresponding to a stoichiometric air-fuel ratio after the above predetermined time period has elapsed.

Also preferably, the predetermined time period is a time period within which there can occur very little change in the operating condition of the engine.

The above and other objects, features and advantages of the invention will be more apparent from the ensuing detailed description taken in conjunction with the accompanying drawings.

DETAILED DESCRIPTION

The method according to the invention will now be described in detail with reference to the drawings showing an embodiment thereof.

Figure 1:
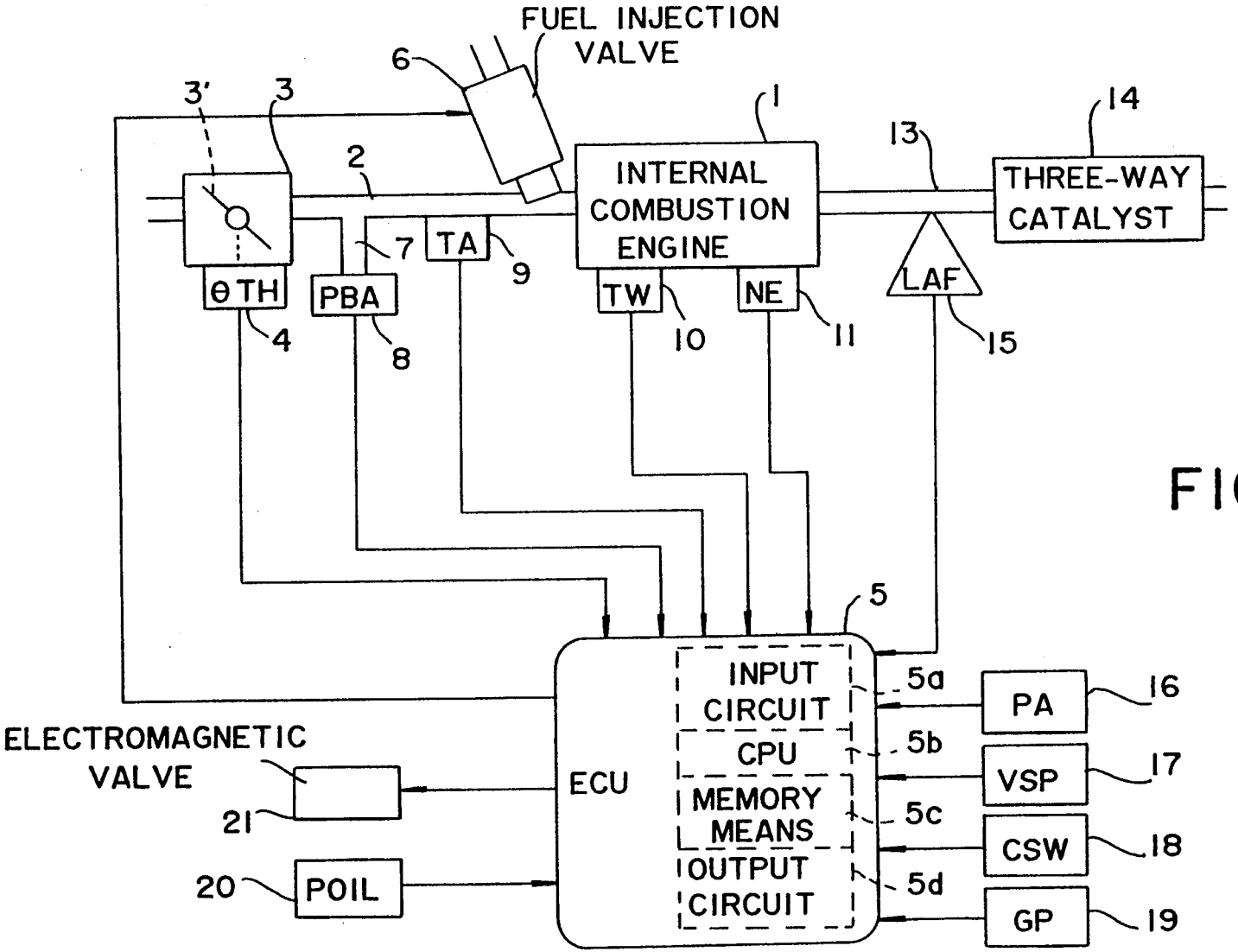
FIG. 1 is a block diagram illustrating the whole arrangement of a fuel supply control system for carrying out the control method of the invention.

Referring first to FIG. 1, there is shown the whole arrangement of a fuel supply control system which is adapted to carry out the control method of this invention. In the figure, reference numeral 1 designates a DOHC straight type four cylinder engine, each cylinder being provided with a pair of intake valves and a pair of exhaust valves, not shown. This engine 1 is arranged such that the operating characteristics of the intake valves and exhaust valves (more specifically, the valve opening period and the lift (generically referred to hereinafter as "valve timing") permit selection between a high speed valve timing adapted to a high engine speed region and a low speed valve timing adapted to a low engine speed region.

In an intake pipe 2 of the engine 1, there is arranged a throttle body 3 accommodating a throttle body 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6 are each provided for each cylinder and arranged in the intake pipe between the engine 1 and the throttle valve 3, and at a location slightly upstream of an intake valve, not shown. The fuel injection valves 6 are connected to a fuel pump, not shown, and electrically connected to the ECU 5 to have their valve opening periods controlled by signals therefrom.

An electromagnetic valve 21 is connected to the output side of the ECU 5 to selectively control the aforementioned valve timing, the opening and closing of this electromagnetic valve 21 being controlled by the ECU 5. The valve 21 selects either high or low hydraulic pressure applied to a valve timing selection mechanism, not shown. Corresponding to this high or low hydraulic pressure, the valve timing is thereby adjusted to either a high speed valve timing or a low speed valve timing. The hydraulic pressure applied to this selection mechanism is detected by a hydraulic pressure (oil pressure) (POIL) sensor 20 which supplies a signal indicative of the sensed hydraulic pressure to the ECU 5.

Further, an intake pipe absolute pressure ($P_{BA}$) sensor 8 is provided in communication with the interior of the intake pipe 2 via a conduit 7 at a location immediately downstream of the throttle valve 3' for supplying an electric signal indicative of the sensed absolute pressure to the ECU 5. An intake temperature ($T_A$) sensor 9 is inserted into the intake pipe 2 at a location downstream of the intake pipe absolute pressure sensor 8 for supplying an electric signal indicative of the sensed intake temperature $T_A$ to the ECU 5.

An engine coolant temperature ($T_W$) sensor 10, which may be formed of a thermistor or the like, is mounted in the cylinder block of the engine 1 for supplying an electric signal indicative of the sensed engine coolant temperature $T_W$ to the ECU 5. An engine rotational speed (Ne) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the ECU 5.

Further electrically connected to the ECU 5 are an atmospheric pressure ($P_A$) sensor 16, a vehicle speed sensor 17, a clutch sensor 18 for detecting when the clutch is engaged and disengaged, and a gear position sensor 19 for detecting the shift position of a transmission, not shown. The signals from all these sensors are supplied to the ECU 5.

The ECU 5 comprises an input circuit 5a having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5b, memory means 5c storing various operational programs which are executed in the CPU 5b and for storing results of calculations therefrom, etc., and an output circuit 5d which outputs driving signals to the fuel injection valves 6 and the electromagnetic valve 21.

The CPU 5b operates in response to the above-mentioned signals from the sensors to determine operating conditions in which the engine 1 is operating such as an air-fuel ratio feedback control region and open-loop control regions, and calculates, based upon the determined operating conditions, the valve opening period or fuel injection period $T_{OUT}$ over which the fuel injection valves 6 are to be opened by the use of the following equation (1) in synchronism with inputting of TDC signal pulses to the ECU 5:

$$T_{OUT}=T_i\times KCMDM\times KLAF\times K_1+K_2 \quad (1)$$

where $T_i$ represents a basic fuel amount, more specifically a basic fuel injection period which is determined according to the engine rotational speed Ne and the intake pipe absolute pressure $P_{BA}$. The value of $T_i$ is determined by a $T_i$ map stored in the memory means 5c.

KCMDM is a modified desired air-fuel ratio coefficient which is set by means of a program shown in FIGS. 2a and 2b, described hereinafter, according to engine operating conditions, and calculated by multiplying a desired air-fuel ratio coefficient KCMD representing a desired air-fuel ratio by a fuel cooling correction coefficient KETV. The correction coefficient KETV is intended to apply a prior correction to the fuel injection amount in view of the fact that the supply air-fuel ratio varies due to the cooling effect produced when fuel is actually injected, and its value is set according to the value of the desired air-fuel ratio coefficient KCMD. Further, as will be clear from the aforementioned equation (1), the fuel injection period $T_{OUT}$ increases if the desired fuel-air injection ratio coefficient KCMD increases, so that the values of KCMD and KCMDM will be in direct proportion to the reciprocal of the air-fuel ratio A/F.

KLAF is an air-fuel ratio correction coefficient which is set such that the air-fuel ratio detected by the LAF sensor 15 during feedback control coincides with the desired air-fuel ratio, and is set to predetermined values depending on engine operating conditions during open-loop control.

$K_1$ and $K_2$ are other correction coefficients and correction variables, respectively, which are calculated based on various engine parameter signals to such values as to optimize characteristics of the engine such as fuel consumption and accelerability depending on engine operating conditions.

The CPU 5b outputs a valve timing selection command signal depending on engine operating conditions, which causes opening and closing of the electromagnetic valve 21.

The CPU 5b performs calculations as described hereintofore, and supplies the fuel injection valves 6 and electromagnetic valve 21 with driving signals based on the calculation results through the output circuit 5d.

Figures 2, 2A:
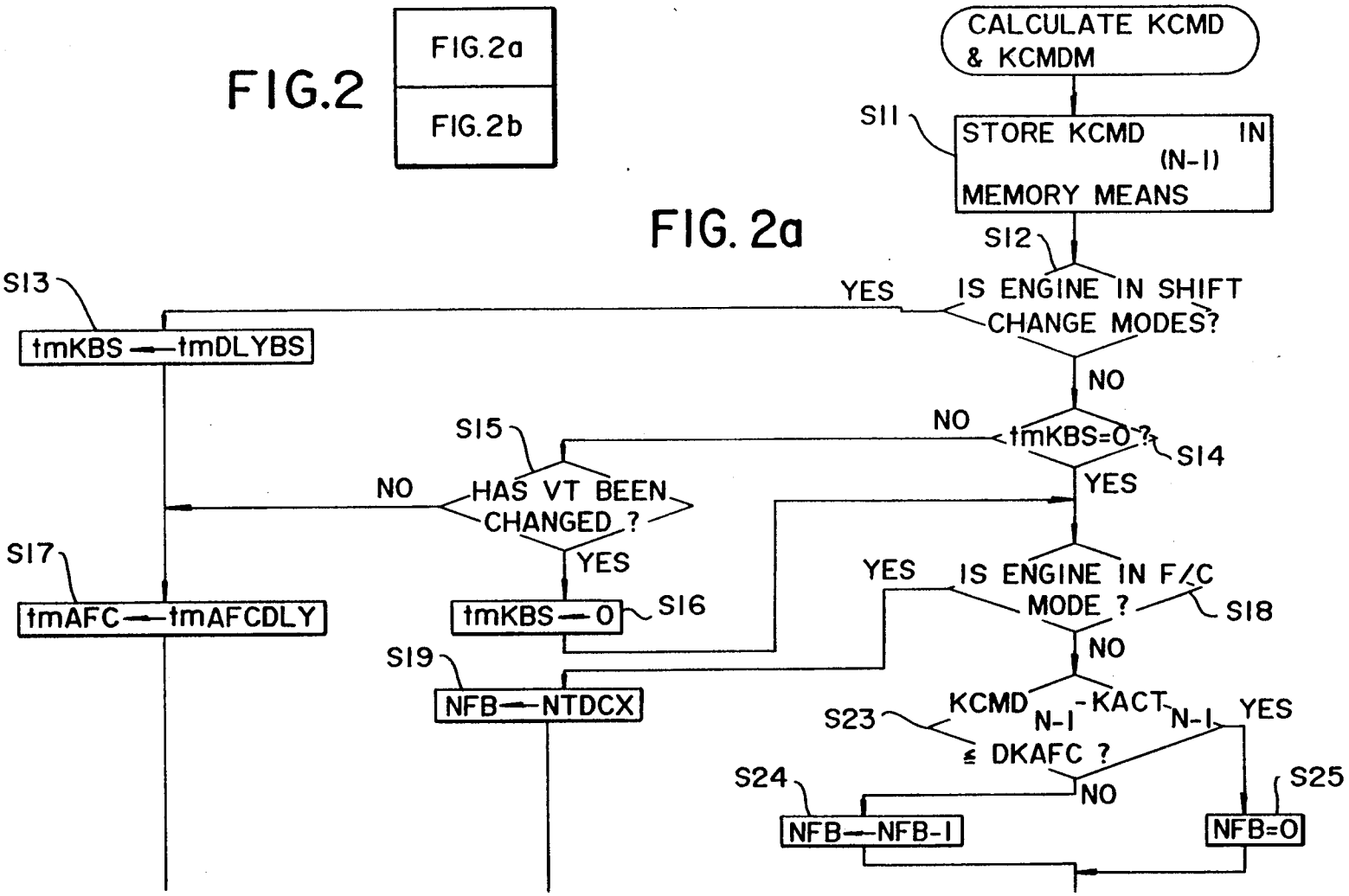
FIGS. 2*a* and 2*b* are flowcharts of a program for calculating a desired air-fuel ratio coefficient (KCMD) and a modified desired air-fuel ratio coefficient (KCMDM).
Figure 2B:
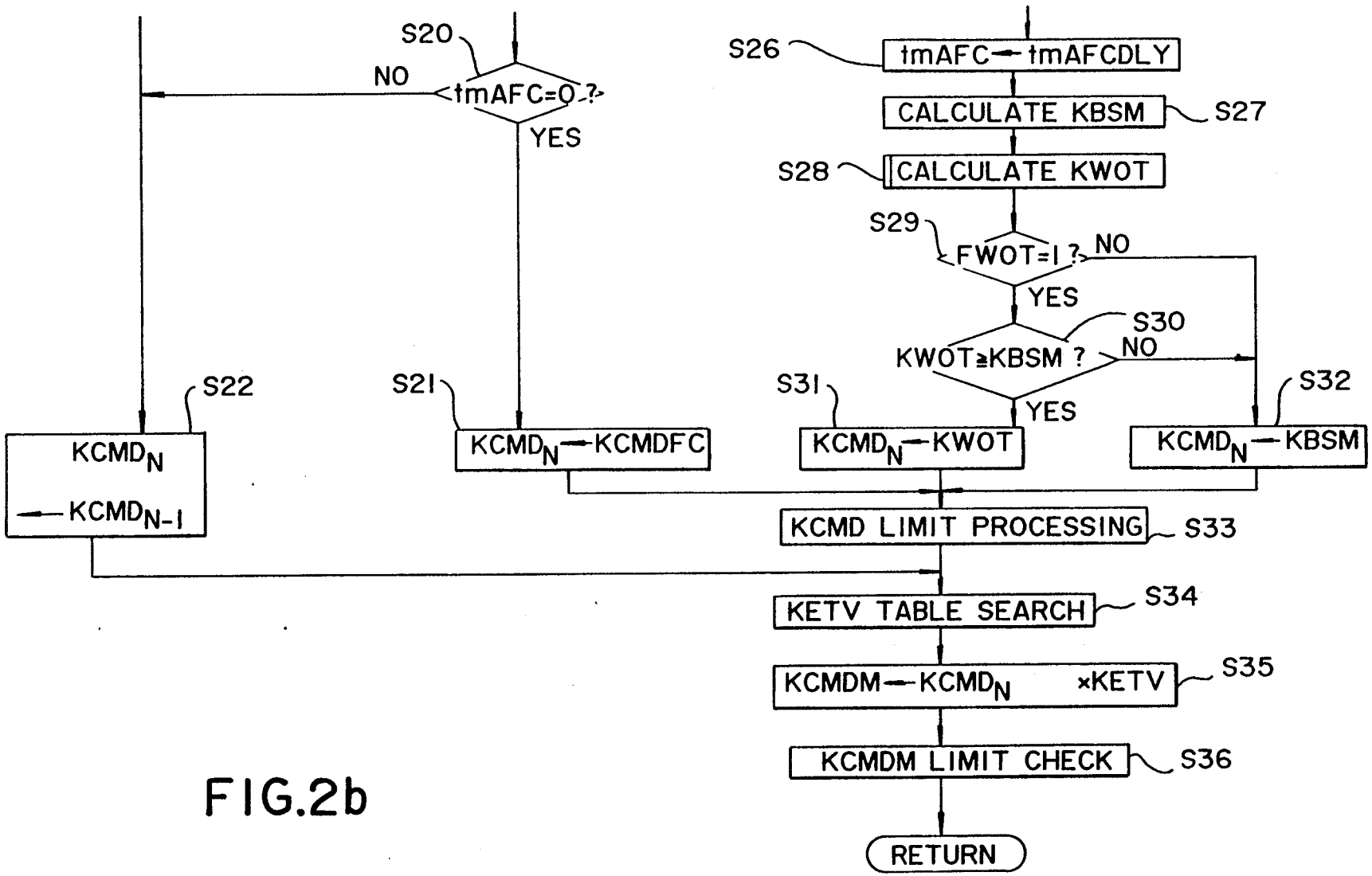

FIGS. 2a and 2b show a flowchart of a program which calculates the desired air-fuel ratio coefficient KCMD and modified air-fuel ratio coefficient KCMDM. This program is carried out in synchronism with inputting of each TDC signal pulse to the ECU 5.

At a step S11, the calculation value $KCMD_{N-1}$ of the desired air-fuel ratio coefficient KCMD in the immediately preceding loop is stored in the memory means 5c. The memory means 5c can store for example 15 values of KCMD, so that the results of calculating KCMD in a maximum of up to 15 preceding loops can be read and used. At a step S12, it is determined whether or not the engine is in shift change mode, (i.e. whether or not the transmission is being shifted). This determination depends on the output signal from the clutch sensor 18 detecting whether or not the clutch is engaged. If the answer to the question of the step S12 is affirmative (YES), i.e. if the engine is in the shift change mode, a shift change delay timer tmKBS for measuring the time period elapsed after termination of shift change, is set to a predetermined shift change delay period tmDLYBS (e.g. 500 milliseconds) and the timer is started (step S13). Further, an F/C delay timer tmAFC for measuring the fuel cut period is set to a predetermined F/C delay period tmAFCDLY (300 milliseconds), and the timer is started (step S17). Then the value of KCMD in the present loop, i.e. $KCMD_N$, is set to a value assumed in the immediately preceding loop, $KCMD_{N-1}$ (step S22), and the program proceeds to a step S34.

If the answer to the question of the step S12 is negative (NO), i.e. if the engine is not in the shift change mode, it is determined whether or not the count value of the shift change delay timer tmKBS is equal to 0 (step S14). If the answer to this question is affirmative (YES), i.e. if the predetermined time period tmDLYBS has elapsed after termination of shift change, the program proceeds immediately to a step S18. If the answer to this question is negative (NO), i.e. if the predetermined time period tmDLYBS has not elapsed after termination of shift change, it is determined whether or not the valve timing has been changed (step S15). If the answer to the question of the step S15 is negative (NO), the program proceeds to the step S17, while if the answer is affirmative (YES), the shift change delay timer tmKBS is set equal to 0 and the program proceeds to the step S18.

In this manner, the desired air-fuel ratio coefficient KCMD is held at a value assumed in the immediately preceding loop during shift change and before the predetermined time period tmDLYBS elapses after termination of shift change. However, even on these occasions, if the valve timing has been changed, the program proceeds immediately to the step S18. The desired air-fuel ratio therefore is prevented from largely fluctuating due to a change in the engine operating condition during shift change or immediately after shift change, and hence deviation of the supply air-fuel ratio from the desired value is prevented. Further, in this embodiment, when high speed valve timing has been selected, KCMD is not set to a leaner value than the stoichiometric air-fuel ratio (A/F=14.7) (inhibition of so-called "lean burn"), though this is not shown. However, there are some cases wherein "lean burn" is carried out when high speed valve timing is selected if KCMD is continuously held at a value thereof in the immediately preceding loop when the valve timing has been changed. To avoid such a situation from occurring, therefore, the holding of KCMD at a value in the immediately preceding loop is immediately terminated if the valve timing is changed.

At a step S18, it is determined whether or not the engine is in fuel cut mode. If the answer to this question is affirmative (YES), a TDC counter NFB is set to a predetermined value NTDCX (e.g. 6) (step S19), and it is determined whether or not the count value of the F/C delay timer tmAFC is equal to 0 (step S20). The TDC counter NFB is provided to adjust the gain of the air-fuel ratio feedback control according to the number of TDC signal pulses after termination of fuel cut. If the answer to the question of the step S20 is negative (NO), i.e. if the fuel cut period is less than the predetermined time period tmAFCDLY, the program proceeds to the step S22, and KCMD is held at a value thereof in the immediately preceding loop. If the answer to the question of the step S20 is affirmative (YES), i.e. if the fuel cut period is equal to or longer than the predetermined time period tmAFCDLY, KCMD is set to a predetermined value KCMDFC which approximately corresponds to the stoichiometric air-fuel ratio (A/F=14.7), and the program proceeds to a step S33.

As noted above, if the fuel cut period is short (less than tmAFCDLY), KCMD is held at a value assumed in the immediately preceding loop, while if the fuel cut period is longer than tmAFCDLY, KCMD is set to a predetermined value KCMDFC which approximately corresponds to the stoichiometric air-fuel ratio. The supply air-fuel ratio immediately after termination of fuel cut is thus suitably controlled. In other words, if the fuel cut period is short, the engine operating condition shows very little change, and the desired supply air-fuel ratio can rapidly be reached by starting feedback control from the value immediately preceding the fuel cut. On the other hand, if the fuel cut period is long, KCMD is set to an essentially central value, and therefore the desired air-fuel ratio can rapidly be reached, irrespective of whether the value of KCMD which depends on the engine operating condition after termination of fuel cut is on the lean or the rich side.

If the answer to the question of the step S18 is negative (NO), i.e. if the engine is not in the fuel cut mode, an equivalent ratio $KACT_{N-1}$ representing the detected air-fuel ratio (referred to hereinafter as "detected air-fuel ratio") in the immediately preceding is calculated from the output of the LAF sensor 15 obtained in the immediately preceding loop. Then, it is determined whether or not the absolute value of the difference between the value of KCMD in the immediately preceding loop, i.e. $KCMD_{N-1}$, and the value of this equivalent ratio in the preceding loop, $KACT_{N-1}$, is less than a predetermined value DKAFC (e.g. corresponding to 0.8 in terms of A/F) (step S23). If the answer to this question is affirmative (YES), i.e. if the aforementioned difference is less than the predetermined value DKAFC, the TDC counter NFB is reset equal to 0 (step S25). If on the other hand the answer to this question is negative (NO), the count value of the counter NFB is decremented by 1 (step S24), and the program proceeds to a step S26.

At the steps S23–S25, as described above, if the difference between the desired air-fuel ratio coefficient KCMD and the detected air-fuel ratio KACT is large (higher than DKAFC) immediately after termination of fuel cut, the count value of the TDC counter NFB is higher than 1. As a result, by another routine, the gain of the air-fuel ratio feedback control is set to a value larger than when the air-fuel ratio feedback control gain is NFB=0.

At the step S26, the aforementioned F/C delay timer tmAFC is set to the predetermined time period tmAFCDLY, and the timer is started. Then, a reference value KBSM of the desired air-fuel ratio coefficient is calculated (step S27), a high load desired value KWOT which is applied when the engine is in a predetermined high load operating region is calculated (step S28), and the program proceeds to a step S29.

At the step S27, the reference value KBSM is normally read from KBSM maps set according to the engine rotational speed Ne and the absolute pressure $P_{BA}$ in the intake pipe. However, when the engine coolant temperature $T_W$ is low, KBSM is read from a KTWLAF map set according to the engine coolant temperature $T_W$ and the absolute pressure $P_{BA}$ in the intake pipe. The KBSM maps comprise a map for high speed valve timing which is used when high speed valve timing is selected, and a map for low speed valve timing which is used when low speed valve timing is selected.

At the step S28, the high load desired value KWOT is read from KWOT maps set according to the engine speed Ne and the absolute pressure $P_{BA}$ in the intake pipe. The KWOT maps also comprise a map for high speed valve timing and a map for low speed valve timing.

At the step S29, it is determined whether or not a flag FWOT, which is set to 1 when the engine is in the predetermined high load operating region, is equal to 1. If the answer to this question is negative (NO), i.e. if the engine is not in the predetermined high load operating region, the reference value KBSM calculated in the step S27 is taken as the value of the desired air-fuel ratio coefficient in the present loop, $KCMD_N$, at a step S32, and the program proceeds to a step S33. If the answer to the question of the step S29 is affirmative (YES), i.e. if the engine is in the predetermined high load operating region, it is determined whether or not the high load desired value KWOT is higher than the reference value KBSM (step S30). If the answer to this question is negative (NO), i.e. if KWOT<KBSM, the program proceeds to the step S32, while if the answer is affirmative (YES), i.e. if KWOT≧KBSM, $KCMD_N$ is set equal to KWOT and the program proceeds to the step S33.

In this manner, the desired air-fuel ratio coefficient $KCMD_N$ is set to the reference value KBSM when the engine is operating in a region different from the predetermined high load operating region, and is set to the larger one of the reference value KBSM and the high load desired value KWOT, when the engine is operating in the predetermined high load operating region.

At the step S33, limit processing of KCMD is carried out. This limit processing is intended to prevent the difference between the value of KCMD in the immediately preceding loop and the value of KCMD in the present loop from exceeding an upper limit set according to engine operaring conditions, and to prevent the value of KCMD from changing abruptly. However, if the value of KCMD is leaner than the stoichiometric air-fuel ratio, it is immediately increased to a value corresponding to the stoichiometric air-fuel ratio when for example the accelerator pedal is rapidly depressed.

After KCMD limit processing, at a step S34, the fuel cooling correction coefficient KETV is read from a table according to the value of KCMD, and by multiplying with the value of KCMD, the modified desired air-fuel ratio coefficient KCMDM is calculated (step S35). Next, a limit check is performed on the value of KCMDM, and the program is terminated. In this limit check, it is determined whether or not the value of KCMDM is within a range defined by predetermined upper and lower limits. If it is outside this range, the value of KCMDM is set to either the upper limit or the lower limit.

After executing this program, the air-fuel ratio correction coefficient KLAF is calculated such that the desired air-fuel ratio coefficient $KCMD_{N-P}$ calculated P loops previously, coincides with the value $KACT_N$ of the detected air-fuel ratio in the present loop, under engine operating conditions which permit air-fuel ratio feedback control.

What is claimed is:

1. An air-fuel ratio feedback control method for an internal combustion engine having an exhaust passage, and an exhaust gas ingredient concentration sensor arranged in said exhaust passage, said sensor having output characteristics in approximate proportion to the concentration of an ingredient in exhaust gases from said engine, wherein when said engine is in a predetermined operating condition, the air-fuel ratio of an air-fuel mixture supplied to said engine is feedback-controlled to a desired air-fuel ratio dependent on said predetermined operating condition of said engine, and when said engine is in a predetermined deceleration condition, the fuel supply to said engine is cut off, the method comprising the steps of:

(1) when said engine has shifted from an operating condition other than said predetermined deceleration condition to said predetermined deceleration condition, holding said desired air-fuel ratio at a value assumed immediately before said engine shifts from said operating condition other than said predetermined deceleration condition to said predetermined deceleration condition, for a predetermined time period after said shifting; and (2) starting said feedback control of the air-fuel ratio with the held value as an initial value of said desired air-fuel ratio when said engine has shifted to said predetermined operating condition.

2. The method as claimed in claim 1, further including the step of holding said desired air-fuel ratio at a value substantially corresponding to a central value of said air-fuel ratio after said predetermined time period has elapsed.

3. The method as claimed in claim 2, wherein said desired air-fuel ratio is held at a value substantially corresponding to a stoichiometric air-fuel ratio after said predetermined time period has elapsed.

4. The method as claimed in claim 1, wherein said predetermined time period is a time period within which there can occur very little change in the operating condition of said engine.

* * * * *